United States Patent [19]

Gentry

[11] 4,307,634

[45] Dec. 29, 1981

[54] TELESCOPING NUT DRIVER

[76] Inventor: Samuel Gentry, 219A Fourth, Chula Vista, Calif. 92010

[21] Appl. No.: 159,765

[22] Filed: Jun. 16, 1980

[51] Int. Cl.[3] ..... B25B 13/58

[52] U.S. Cl. ..... 81/185; 81/177 E

[58] Field of Search ..... 81/185, 439, 177 E, 81/177 N

[56] References Cited

U.S. PATENT DOCUMENTS

| | | | |
|---|---|---|---|
| 1,107,769 | 8/1914 | Earl et al. | 81/185 |
| 1,618,715 | 2/1927 | Lammars et al. | 81/185 |
| 2,660,082 | 11/1953 | Dreese | 81/185 |
| 3,779,105 | 12/1973 | Triplett et al. | 81/185 X |

FOREIGN PATENT DOCUMENTS

| | | | |
|---|---|---|---|
| 194145 | 3/1923 | United Kingdom | 81/185 |

*Primary Examiner*—James G. Smith

*Attorney, Agent, or Firm*—Brown & Martin

[57] ABSTRACT

A telescoping hex head nut driver comprising a first hexagonal socket on a shank, a handle attached to said shank, with smaller (inner) hexagonal sockets and shanks telescoping within the first hexagonal socket and shank. The inner sockets can be extended to engage smaller hex head nuts and means are provided in the handle to extend and retract the inner sockets.

7 Claims, 7 Drawing Figures

TELESCOPING NUT DRIVER

BACKGROUND OF THE INVENTION

This invention relates to hand tools and in particular to a new and improved hexagonal nut driver.

In the cabinetry and other components of appliances such as refrigerators, trash compactors, dishwashers, TV cabinets as well as major appliances such as furnaces and air-conditioners, whether in homes or in buildings such as for offices, apartments and the like, three standard sizes of fasteners constitute a majority (approximately 90%) of all the fasteners used in the appliances. In this industry, a ¼ inch, a 5/16 inch and a ⅜ inch hexagonal sheet metal nuts (Hexnuts) are such fasteners. Consequently, to service such appliances, it is common practice today to use three separate and distinct hexnut drivers to disassemble and reassemble the appliances. For example; to change a door gasket in a refrigerator, a ¼ inch hexnut driver is required; to change a evaporator fan motor, a 5/16 hexnut driver is used; and if other parts are needed to be changed, usually still another hexnut driver, a ⅜ inch size, is used.

One of the problems in the industry is that often the service man spends half his time exchanging tools to service the appliance and sometimes at least one of the tools is missing or misplaced so that a trip to another location to find the missing tool is necessary. This problem is further complicated by the fact that, while a screwdriver can sometimes replace the missing tool, it has become increasingly popular to eliminate the screwdriver slot from the hexnut so that this substitution is becoming impossible.

In any event, with the necessity for three separate tools, possibly four if a screwdriver is needed to do the job; it becomes apparent that at the present time servicing appliances is unnecessarily time consuming and bothersome and there is a need for a single tool to replace the present three or four tools need for servicing appliances and the answer to this need is the primary object of this invention.

SUMMARY OF THE INVENTION

The invention which attains the foregoing object comprises a tool having a first or outside hexagonal (hex) socket, for engaging a hexnut of a selected size, on, or forming part of, a shank with a handle surrounding a portion of the shank. Two additional smaller hexagonal sockets and shanks are nested in telescoping relationship within the outer socket shank and handle and capable of being extended outwardly, individually, of the first hex socket for engaging smaller hexnuts. The size of the telescoping two hex sockets are such that the sidewalls of the sockets and shanks engage in sliding relationship but relative rotation therebetween is prevented and the inner sockets are so arranged so that the hex sockets when nested (retracted) serve as stop mechanisms for the hexnut being driven at the time.

On the other hand, the two outer hex sockets and shanks serve as strengthening devices for the inner hex sockets and shanks so that additional torque can be applied to the hex nut being driven without damage to the hex socket which engaged the hex nut. The two inner telescoping shank are also provided with pins which extend through the handle and are engaged by gripping means by which the retracted sockets may be extended so as to engage the selected hexnut corresponding to the size of the selected hex socket.

As will be clear to these skilled in this art, that, in addition to being a convenience and a time saver, the ability of this tool to extend the smaller hex sockets to engage a correspondingly sized hexnut, has the advantage of allowing the socket to engage such a hexnut whether near a flange or in a concave or recessed area where the larger hexagonal socket would otherwise interfere. It has been suggested that an alternative to this tool would be a socket type driver where the inner sockets would be spring loaded and flush with the outer socket end so that the inner sockets would retract against the spring load when the hexnut for the outer socket was being driven, but this type of driver would not be useful where the hexnut to be driven is located near a flange or in a concave or recessed area.

DETAILED DESCRIPTION OF THE INVENTION

Figures 1, 2, 3, 4, 5, 6, 7:
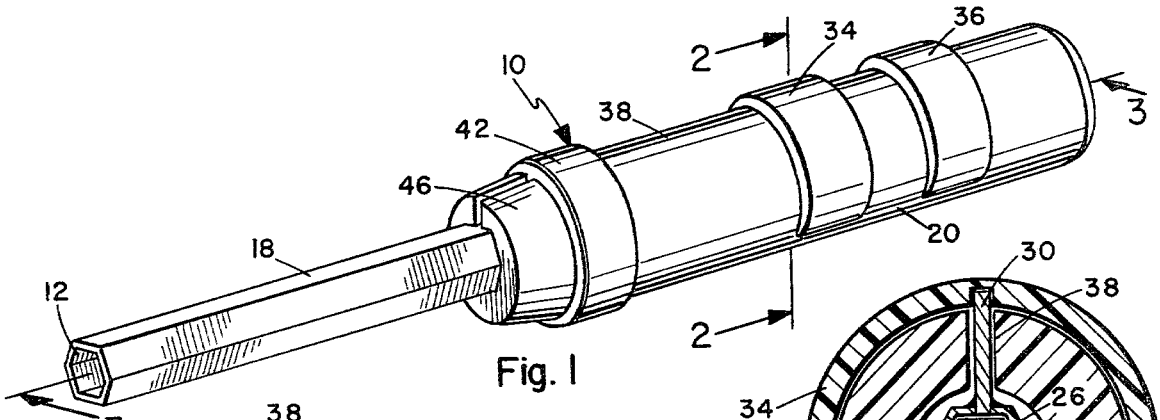
FIG. 1 is a perspective view of the tool.
FIG. 2 is an enlarged sectional view taken on line 2—2 of FIG. 1.
FIG. 3 is a sectional view taken on line 3—3 of FIG. 1.
FIG. 4 is a sectional view taken on line 4—4 of FIG. 3.
FIG. 5 is a side elevational view of the tool showing the extension of the intermediate socket.
FIG. 6 is a side elevational view showing the extension of the inner socket.
FIG. 7 is a side elevational view of the socket cut away to show use of double sockets for added strength.

The drawings show a telescoping hexnut driver 10 with a first or outer hexagonal head or socket 12 and two inner hexagonal heads or sockets 14 and 16, all disposed in telescoping relationship. The first hexagonal head is formed on, that is, as part of, an elongated shank 18 shown hexagonal in cross section with a handle 20 fixed to a portion of the shank. The shank spaces the handle from the socket and its length may vary depending on the desires of those skilled in the art.

To fix the handle to the shank, the handle is provided with a central axially oriented bore 22, hexagonal in cross section, at least part of the way through the handle to receive the outer shank. The remainder of the bore 22 need not be hexagonal but in any event a shoulder 24 is provided as a stop means for positioning the outer shank. The size, length and material of the handle may be selected from a number of suitable materials such as wood or plastic used in this art. Similarly, the size and length of the shank 18 and the material for the shank and socket may be selected from a number of materials used in this art. Typical example of material would be that metal used in the present sparkplug removal hexagonal tools formed of tubular material.

Immediately within the outside hexagonal socket 12 is the second or intermediate, hexagonal socket 14 small enough to telescope within the outer socket and provided with a shank 26 which telescopes within the outer shank 18. Similarly, the third hexagonal socket 16 also the size to telescope within the second hex socket also provided with a shank 28 which telescopes within the second shank. The size of the second and third hex sockets, of course, depend from the selection of the first hex socket but within the industry which the invention is directed, the inner side wall size of the first hex socket is $\frac{3}{8}$ inch to accept a $\frac{3}{8}$ inch hexnut, the second hexagonal socket will accept a 5/16 hexnut and the third hexagonal socket will accept a $\frac{1}{4}$ inch hexnut.

To extend the inner hex sockets from their respective nested or retracted positions, the second and third shank are each provided with pins 30 and 32 extending radially from the shank sidewalls through the handle 20 to engage, respectively, gripping means; one gripping means for each pin and shank as at 34 and 36. The handle is provided with an elongated axial slot 38 to permit the pins to extend therethrough and to permit axial movement of the pins with respect to the handle. The lengths of the shanks 26 and 28 accomodate the two pins 30 and 32 and their independent movement in slot 38. Each gripping means comprises a resilient circular ring member, preferably of a plastic such as PVC, of a slightly smaller diameter than the diameter of the handle and extending a little more than $\frac{1}{2}$ of the periphery of the handle, to engage the handle in a resilient gripping relationship sufficient to maintain the gripping means on the handle yet permit its movement in the axial direction and to remain in the place positioned by the operator's hand. Thus, movement of the gripping means by the operator's thumb will move the inner shanks and the hex sockets outwardly of their respective nested position for use. Too, each gripping means 34 and 36 is tapered from its thickest portion near its pin receiving portion to the end or edge. This is shown most clearly in FIG. 2.

It is to be noted that when the two inner hex sockets are in their retracted position, they are spaced from the outer end of a sufficient depth to permit the hexnut to be received in the first socket; see FIG. 3.

Similarly, when the second hex socket 16 is extended, the third socket is recessed sufficiently to allow a hexnut to be received in the second socket, see FIG. 5. To avoid a situation where the inner socket is used on a hexnut without a flange, a plug 40 is used to prevent the hexnut from entering the shank too far. The second and outer hex sockets can eject a hexnut by simply extending either the intermediate or inner socket.

Important in this invention also is the fact that if it is desired to place more torque on the hexnut in the second or third sockets, the intermediate socket and/or the outer socket can be telescoped toward the nut to provide strengthening sidewall material, see FIG. 6. Similarly, if the intermediate socket is the one being used, the outer socket can be telescoped over the intermediate socket to provide additional strength. This is shown more clearly in FIG. 7.

Another important feature of the invention, is the provision of a ring 42 free to rotate relative to the handle in peripheral groove 44 to facilitate use of the tool. By holding the ring with one hand, the tool can be held in place while the other hand is free to grip and regrip the handle for applying torque to the hex nut. Note, to insert the ring 42 over the handle, the handle is tapered as at 46. The ring of a material similar to the gripping means 34 and 36 and split to facilitate insertion and removal from the handle.

Finally, another important aspect of this invention is the ease for repair of the tool. The gripping means and ring 42, being resilient, are easily removed from the handle permitting all of the shanks to be removed by pulling them forward of the handle so that a replacement shank and socket can be introduced. Then the gripping means and ring 42 are replaced.

From the foregoing it can be seen that there has been disclosed a single tool which takes the place of three or more tools for driving a majority of the fasteners used in appliances in today's home and commercial apartment and office buildings.

What is claimed is:

1. A telescoping hexagonal nut driver having a plurality of hexagonally shaped heads, each forming a socket of a different size and adapted to engage correspondingly sized hexagonal nuts for driving said nuts by rotational movement, comprising:

a first hexagonal socket means having a hollow shank;

a handle surrounding a portion of said shank on said first socket means, said handle having an axial slot open at the forward end;

a second hexagonal socket means smaller than said first hexagonal socket means for positioning within said first socket means in sliding engagement with the inner side walls of said first hexagonal socket means, said second socket means having a hollow shank and telescoping outwardly beyond said first hexagonal socket means;

first positioning means in sliding engagement on said handle and surrounding more than half of said handle;

first connection means extending through said slot in said handle behind said first socket means shank and connecting said first positioning means and the shank of said second socket means so that said first positioning means and second socket means shank are slidable together for moving said second socket means outwardly beyond said first socket means;

a third hexagonal socket means smaller than said second hexagonal socket means for positioning within said second socket means in sliding engagement with the inner side walls of said second hexagonal socket means, said third hexagonal socket means having a shank and telescoping outwardly beyond said second socket means;

second positioning means in sliding engagement on the outer periphery of said handle and surrounding more than half of said handle; and second connection means extending through said handle slot behind said second socket means shank and connecting said second positioning means and the shank of said third hexagonal socket means so that said second positioning means and third socket means shank are slidable together for moving said third socket means outwardly beyond said second socket means.

2. A nut driver according to claim 1 wherein the shanks are hexagonal in cross section.

3. A nut driver according to claim 1 or 2, wherein said first positioning means and second positioning means are resilient.

4. A nut driver according to claim 3 wherein said handle includes a resilient split ring disposed around said handle between said first positioning means and said first shank which is free to rotate relative to said handle to aid the tool operator in rotating said handle.

5. The nut driver as claimed in claim 3 wherein the ends of said sockets when nested are such that the ends of the two inner sockets are spaced from the end of the outer socket to permit reception of a hex nut and when the second socket is extended beyond the first socket, the end of the third socket is spaced from the end of the second socket to permit reception of a hex nut, and stop means is spaced from the end of said third socket to permit insertion of the head of a hex nut.

6. A nut driver according to claim 3 wherein said handle is cylindrical; and wherein said first and second positioning means are substantially ring-shaped, having spaced apart ends, and are tapered toward said ends.

7. A nut driver according to claim 6 wherein the diameter of said first and second positioning means is slightly smaller than said handle.

* * * * *